US008621710B2

(12) United States Patent
Carpinella et al.

(10) Patent No.: US 8,621,710 B2
(45) Date of Patent: Jan. 7, 2014

(54) FURNITURE GLIDE

(75) Inventors: Ralph Carpinella, Woodbury, CT (US); Robert Dombroski, Waterbury, CT (US); David Ferraro, Cheshire, CT (US)

(73) Assignee: Carpin Manufacturing, Inc., Waterbury, CT (US)

( * ) Notice: Subject to any disclaimer, the term of this patent is extended or adjusted under 35 U.S.C. 154(b) by 186 days.

(21) Appl. No.: 12/629,918

(22) Filed: Dec. 3, 2009

(65) Prior Publication Data

US 2010/0212114 A1 Aug. 26, 2010

Related U.S. Application Data

(63) Continuation-in-part of application No. 12/380,299, filed on Feb. 26, 2009, now abandoned.

(51) Int. Cl.
*A47B 91/06* (2006.01)

(52) U.S. Cl.
USPC ..... 16/42 T; 16/42 R; 248/188.9

(58) Field of Classification Search
USPC ..... 16/42 T, 42 R, 24, 43; 248/188.9
See application file for complete search history.

(56) References Cited

U.S. PATENT DOCUMENTS

| | | | | | |
|---|---|---|---|---|---|
| 2,670,226 | A * | 2/1954 | Becker | 403/276 |
| 3,006,673 | A * | 10/1961 | Swick | 403/122 |
| 3,025,557 | A * | 3/1962 | Knowlton | 16/42 R |
| 3,166,782 | A * | 1/1965 | Miller | 16/42 R |
| 4,518,293 | A * | 5/1985 | Pleickhardt et al. | 411/107 |
| 5,503,492 | A * | 4/1996 | Stevens et al. | 403/297 |
| 6,088,877 | A * | 7/2000 | Swy et al. | 16/42 T |
| D487,392 | S | 3/2004 | Chase | D8/374 |
| D513,583 | S | 1/2006 | Chase | D8/374 |
| 7,234,200 | B2 | 6/2007 | Chase | 16/42 R |
| 7,404,232 | B2 | 7/2008 | Chase | 16/42 T |
| 2007/0204430 | A1 * | 9/2007 | Chase | 16/42 R |
| 2008/0244870 | A1 | 10/2008 | Chase | 16/42 R |
| 2008/0245944 | A1 | 10/2008 | Chase | 248/346.11 |

* cited by examiner

*Primary Examiner* — Emily Morgan
(74) *Attorney, Agent, or Firm* — Alix, Yale & Ristas, LLP

(57) ABSTRACT

A renewable furniture glide for use with a tubular furniture legs includes a foot having a base portion with a bottom surface for contacting a floor and a sleeve portion for receiving a lower end of the furniture leg. The glide also includes a ferrule having a central web, a set of arm segments, and a set of leg segments. The arm segments extend radially outward from the web to engage the inner surface of the furniture leg. The leg segments extend radially outward and axially downward from the web to a foot portion that extends radially outward axially upward to an outer edge. The outer edge engages the inner surface of the foot sleeve portion.

17 Claims, 12 Drawing Sheets

FURNITURE GLIDE

CROSS-REFERENCE TO RELATED APPLICATIONS

This application is a continuation-in-part of U.S. patent application Ser. No. 12/380,299 filed Feb. 26, 2009, now abandoned.

BACKGROUND

The present invention relates to furniture glides, and more particularly to furniture glides having a renewable glide surface.

Furniture glides are available in a variety of styles and constructions, but an essential purpose is to provide an upper portion for receiving a furniture leg and a lower portion defining a sliding surface. U.S. Pat. No. 5,991,974, "Swivelling Furniture Glide", and U.S. Pat. No. 6,154,923, "High Hold Furniture Glide", and U.S. Publication US2002/0088082A1 describe glides of the type having a three main components: (1) a ferrule including a bottom wall, an upstanding cylindrical side wall extending from the bottom wall and defining a socket for receiving a furniture leg, and clip means within the socket, for engaging a received furniture leg, (2) a swivelable glide support shell affixed to the bottom wall of the ferrule, and (3) a glide base affixed to the support shell and defining a substantially flat sliding surface for contacting the floor.

U.S. Pat. No. 6,405,982, "Self-Attaching Sliding Support for Articles of Furniture", describes another type of glide that does not have a ferrule or swivel capability, but rather consists of a generally cup-shaped, unitary body of a resilient element for gripping the legs and an integrated slidable base element for contact with the floor.

In these and other known furniture glides, the sliding surface for contacting the floor is of a material specifically chosen for surface on which the furniture glide will rest. Typical base element materials include steel (usually selected for carpeted floors), hard plastics such as nylon or polyethylene (typically selected for tile floors and older vinyl flooring products containing asbestos), or soft plastics (typically selected for vinyl flooring products that do not contain asbestos and wood floors). The sliding surfaces composed of soft plastics are subject to wear.

SUMMARY

A renewable furniture glide for use with a tubular furniture legs comprises a foot including a base portion having a bottom surface for contacting a floor and a sleeve portion for receiving a lower end of the furniture leg. The glide also comprises a ferrule including a central web, a set of arm segments, and a set of leg segments. The arm segments extend radially outward from the web to engage the inner surface of the furniture leg. The leg segments extend radially outward and axially downward from the web to a foot portion that extends radially outward axially upward to an outer edge. The outer edge engages the inner surface of the foot sleeve portion.

The ferrule leg segments have an outside diameter that is greater than the inside diameter of the furniture leg. The ferrule arm segments have an outside diameter that is greater than the outside diameter of the furniture leg and the inside diameter of the foot sleeve portion.

The outer edges of the ferrule leg segments may penetrate or elastically deform the inner surface of the foot sleeve portion.

The ferrule may be a unitary, monolithic component, with the arm segments disposed intermediate the leg segments.

The base portion also has an upper surface which may have an annular ring extending axially upward from therefrom. The ring and the inner surface of the sleeve portion form an annular trough, where the foot portions of the leg segments are disposed in the annular trough.

The foot portion of each of the leg segments has an upper surface contacted by the lower end of the furniture leg. The furniture leg biases the outer edge of the foot portion against the inner surface of sleeve portion.

BRIEF DESCRIPTION OF THE DRAWINGS

The present invention may be better understood and its numerous objects and advantages will become apparent to those skilled in the art by reference to the accompanying drawings in which.

DETAILED DESCRIPTION

Figure 1:
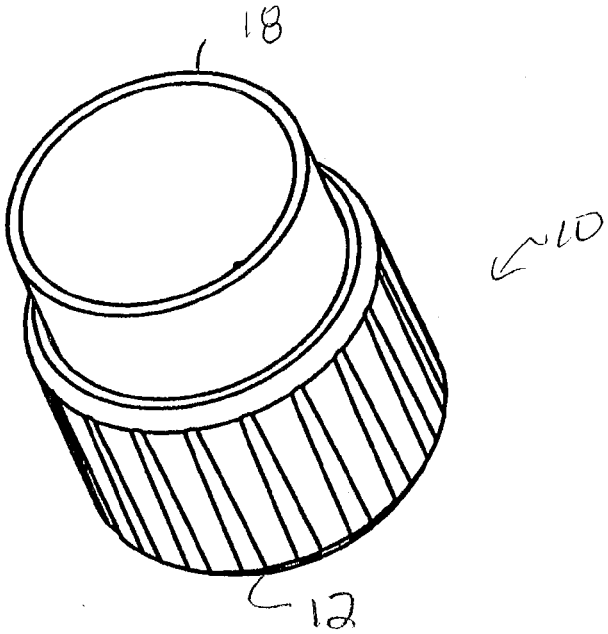
FIG. 1 is a perspective view of a furniture glide in accordance with the disclosure, showing the furniture glide mounted to the lower end of a furniture leg.
Figure 2:
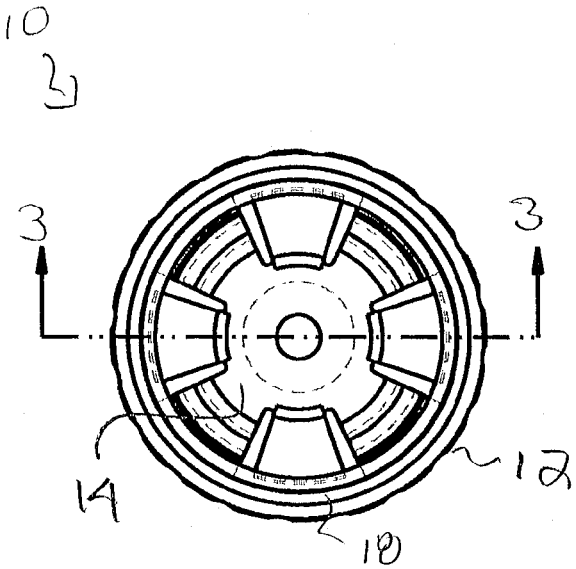
FIG. 2 is a top view of the furniture glide of FIG. 1.

With reference to FIGS. 1-4, a first embodiment of a renewable furniture glide 10 in accordance with the disclosure includes a foot 12 that may be replaced as it nears the end of it's useful life or if the installed foot is not appropriate for the surface on which the furniture will be placed. A ferrule 14, 14', 14" mounts the foot 12 to the lower end 16 of a furniture leg 18.

Figure 3:
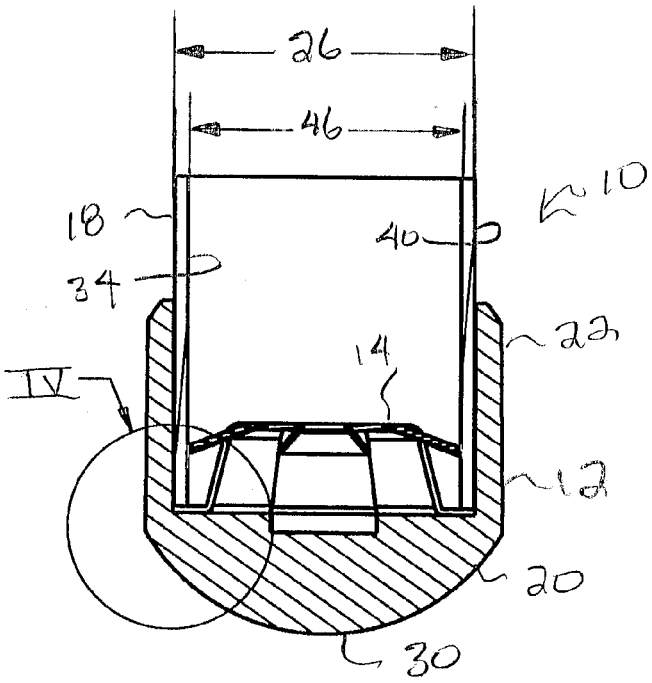
FIG. 3 is a cross-sectional view taken along line 3-3 of FIG. 2.
Figure 4:
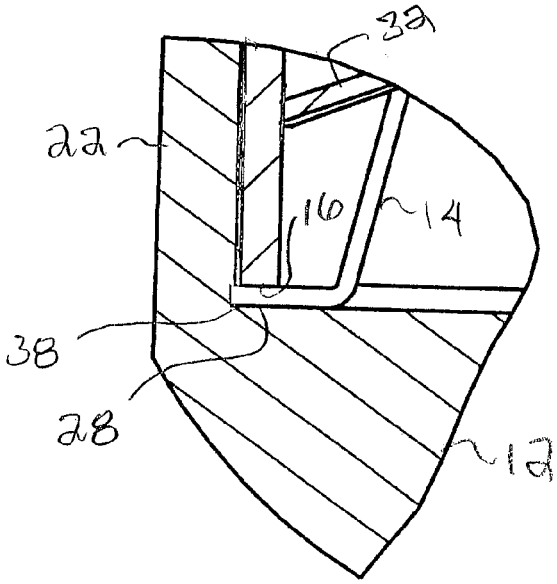
FIG. 4 is an enlarged view of area IV of FIG. 3.
Figure 5:
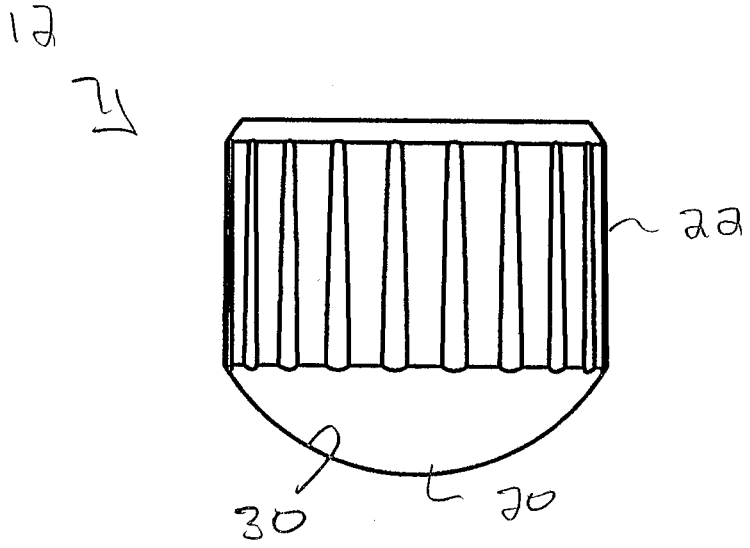
FIG. 5 is a side view of the renewable foot of FIG. 1.
Figure 6:
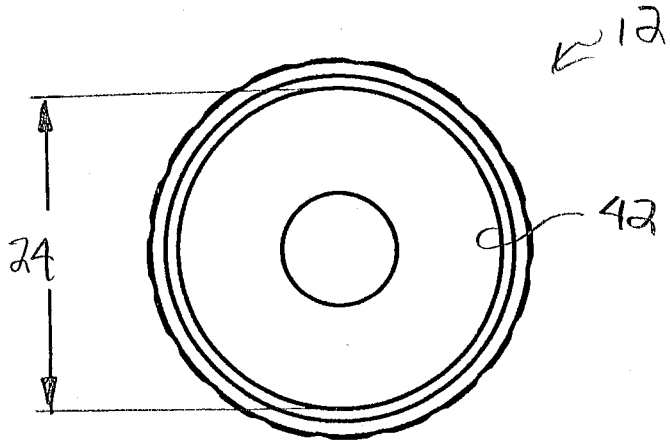
FIG. 6 is a top view of the renewable foot of FIG. 1.

With additional reference to FIGS. 5 and 6, the foot 12 comprises a shell having a base portion 20 for engaging a floor surface and a sleeve portion 22 for receiving the lower end 16 of the furniture leg 18. The foot 12 may be a unitary or singular component molded from of a resilient material, such as a polymer material. The inside diameter 24 of the sleeve portion 22 may be slightly greater than, equal to, or slightly less than the outside diameter 26 of the leg 18, so long as inside diameter 24 is less than the outside diameter of the foot engagement section 28 as explained in greater detail below. As defined herein the term "diameter" means a line segment having end points that lie on the opposite sides of the inner surface (for inside diameter) or the outer surface (for outside diameter) of an object. The bottom surface 30 of the base portion 20 may have an arcuate-shape, as shown in FIGS. 3-5, a plow base configuration as disclosed in U.S. patent application Ser. No. 11/111,410, filed Apr. 21, 2005 (hereby incorporated by reference), or any other shape appropriate for the furniture on which the furniture glide 10 may be used.

Figure 17:
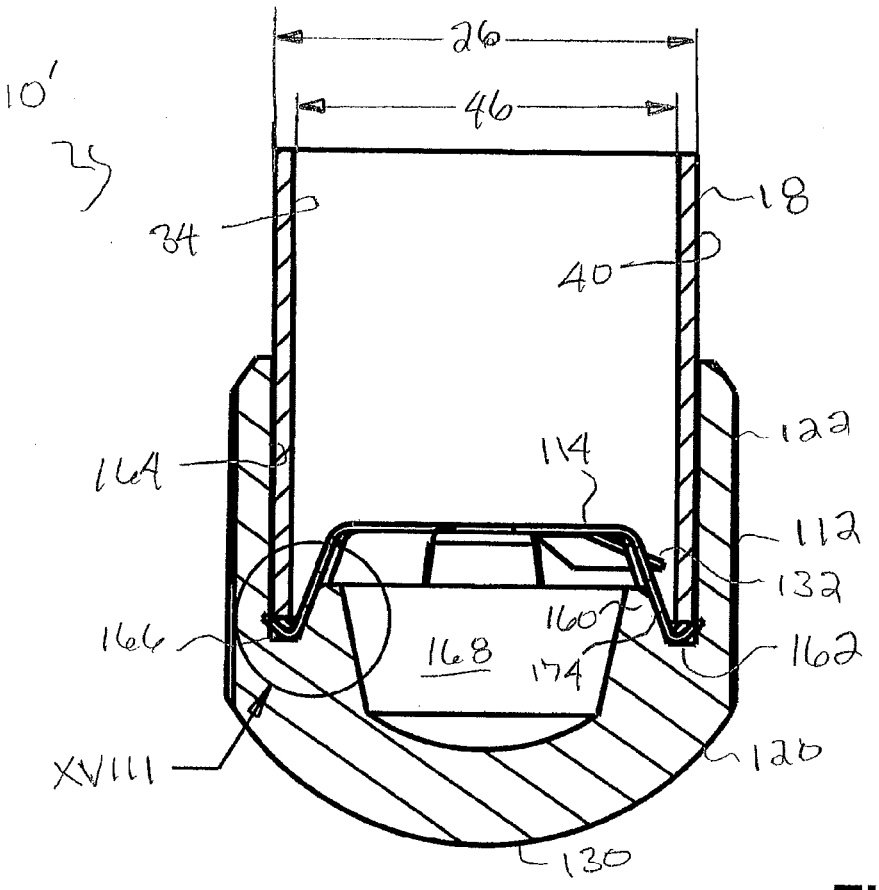
FIG. 17 is a cross-sectional view taken along line 107-107 of FIG. 16.
Figure 18:
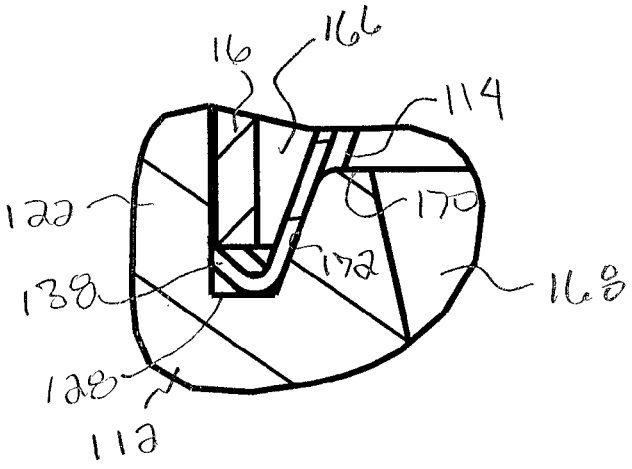
FIG. 18 is an enlarged view of a variation of area XVIII of FIG. 17.
Figure 19:
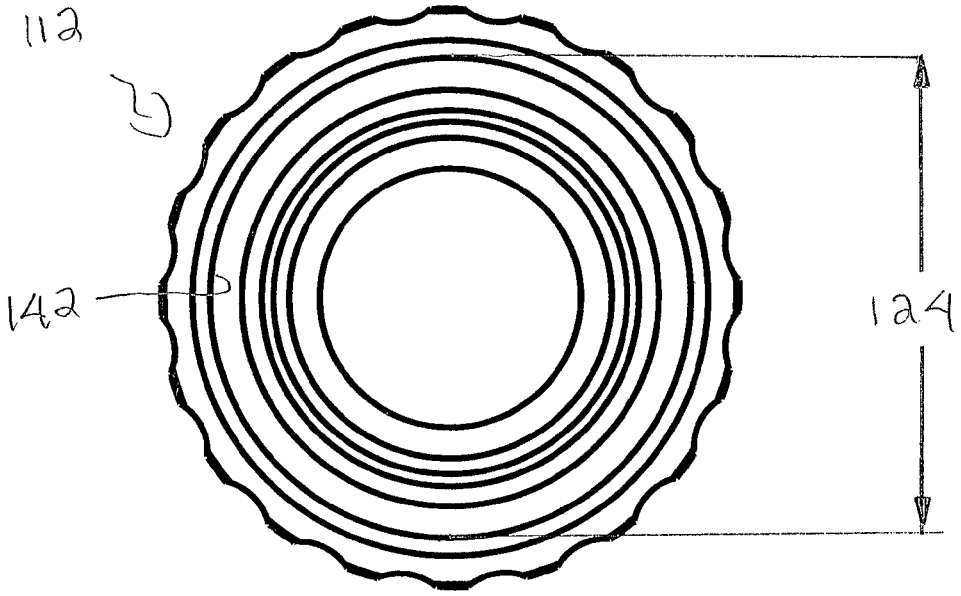
FIG. 19 is a top view of the renewable foot of FIG. 16.

The ferrule 14, 14', 14" includes an upper, leg engagement section 32 that frictionally engages the inner surface 34 of the leg 18 to fixedly mount the ferrule 14, 14', 14" to the leg 18. A lower, foot engagement section 28 has an outside diameter 36 that is greater than both the outside diameter 26 the furniture leg 18 and the inside diameter 24 of the foot sleeve portion 22. When the ferrule leg engagement section 32 is mounted within the furniture leg 18, a portion 38 of the foot engagement section 28 extends radially outward beyond the outer surface 40 of the leg 18 to frictionally engage the inner surface 42 of the sleeve portion 22 of the foot 12 (FIG. 18). In a variation, this portion 38 of the foot engagement section 28 may penetrate or elastically deform inner surface 42 (FIG. 17).

Figure 7:
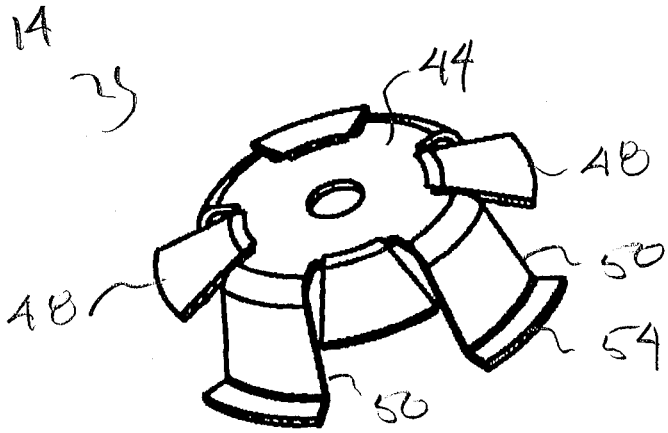
FIG. 7 is a perspective view of the ferrule of FIG. 2.
Figure 8:
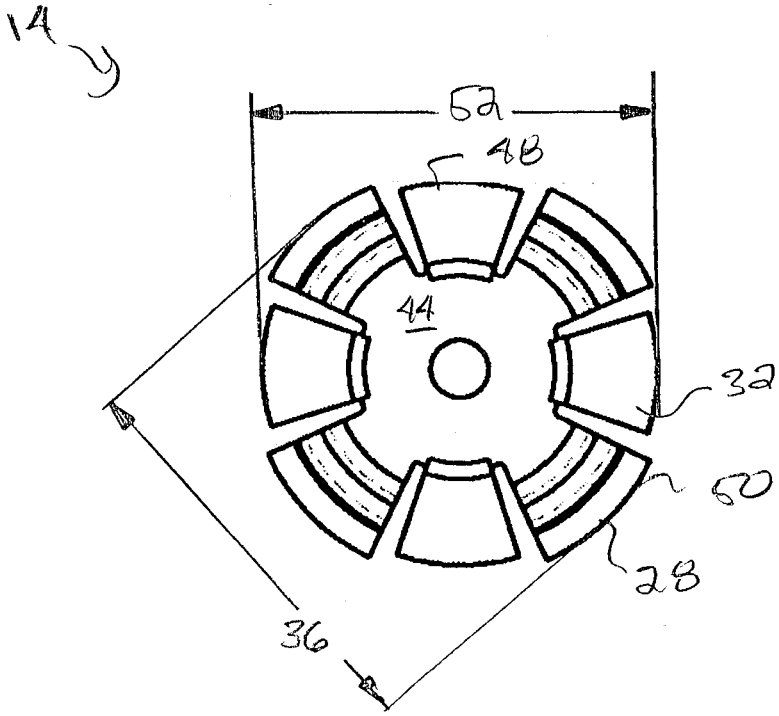
FIG. 8 is a top view of the ferrule of FIG. 2.
Figure 9:
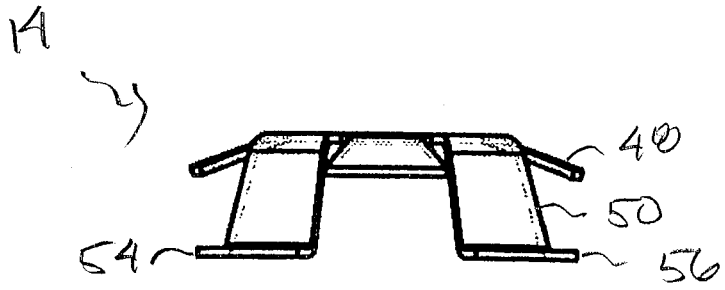
FIG. 9 is a side view of the ferrule of FIG. 2.

With reference to FIGS. 7-9, a first embodiment of the ferrule 14 is a unitary component having a central web 44 which has a footprint smaller than the inside diameter 46 of the furniture leg 18. A set of arm segments 48 and a set of leg segments 50 extending radially outward from the web 44, with the arm segments 48 defining the leg engagement section 32 and the leg segment 50 defining the foot engagement section 28. Generally, the arm segments 48 are disposed intermediate the leg segments 50. The unstressed arm segments 48 extend axially downward to define a diameter 52 greater than the inside diameter 46 of the tubular furniture leg 18. The arm segments 48 are resiliently deformable whereby as the leg engagement section 32 is inserted web first into the furniture leg 18, the arm segments 48 deform inwardly to the smaller inside diameter 46 of the furniture leg 18. The arm segments 48 remain resiliently deformed within the furniture leg 18, exerting a clamping force on the furniture leg 18.

Each leg segment 50 extends axially downward from the web 44 to a foot segment 54 that extends radially outward to an outer edge 56. The outer edges 56 of the foot segments 54 define an outside diameter 36 that is greater than the outside diameter 26 of the tubular furniture leg and the inside diameter 24 of the foot sleeve portion 22.

Figure 10:
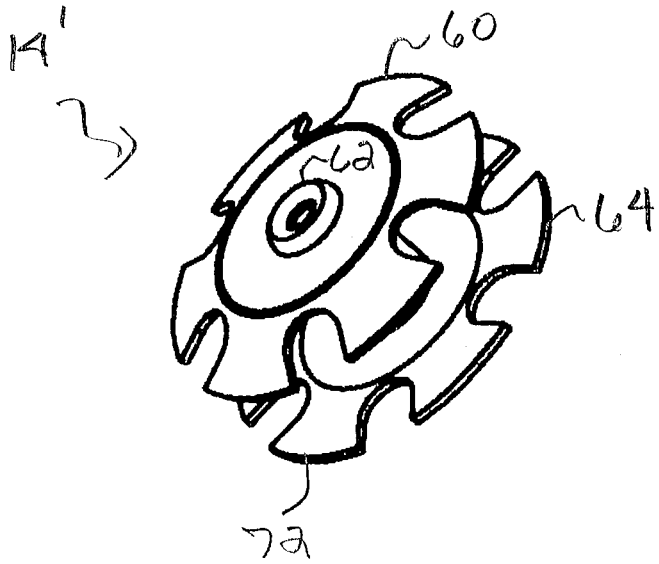
FIG. 10 is a perspective view of a second embodiment of the ferrule.
Figure 11:
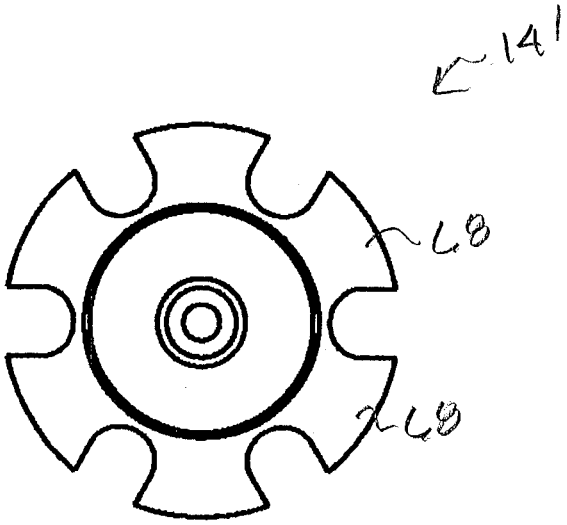
FIG. 11 is a top view of the ferrule of FIG. 10.
Figure 12:
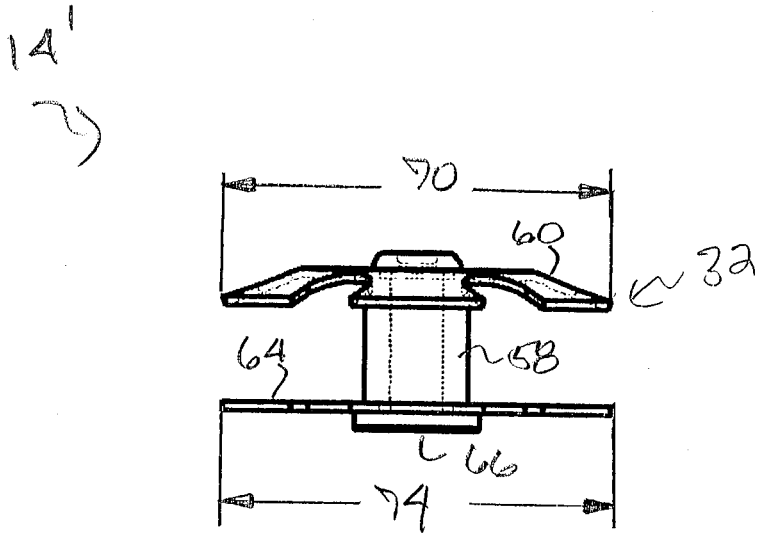
FIG. 12 is a side view of the ferrule of FIG. 10.

With reference to FIGS. 10-12, a second embodiment of the ferrule 14' includes an axially extending hub 58, an upper arm member 60 mounted to the upper end 62 of the hub 58, and a lower arm member 64 mounted to the lower end 66 of the hub 58. The upper arm member 60 includes arm segments 68 that extend radially outward and axially downward to define a diameter 70 greater than the inside diameter 46 of the tubular furniture leg 18. The arm segments 68 are resiliently deformable whereby as the upper arm member 60 is inserted into the furniture leg 18, they resiliently deform inwardly to the smaller inside diameter 46 of the furniture leg 18. The arm segments 68 remain resiliently deformed within the furniture leg 18, exerting a clamping force on the furniture leg 18.

The lower arm member 64 includes arm segments 72 that extend radially outward to define an outside diameter 74 that is greater than the outside diameter 26 of the tubular furniture leg 18 and the inside diameter 24 of the foot sleeve portion 22.

Figure 13:
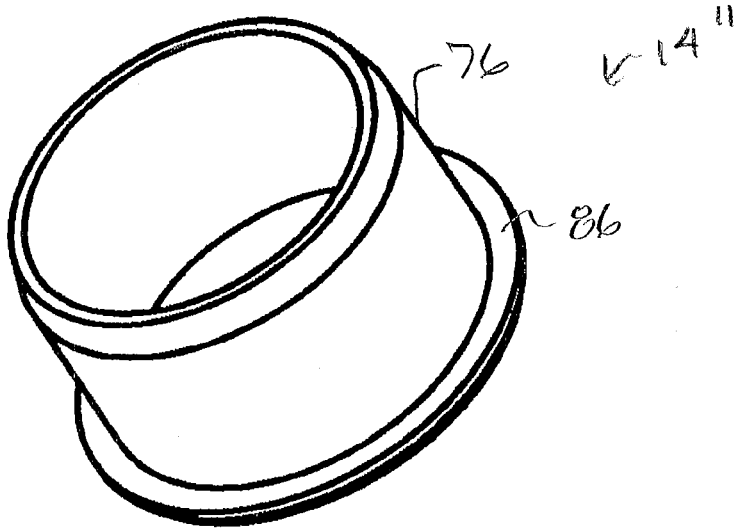
FIG. 13 is a perspective view of a third embodiment of the ferrule.
Figure 14:
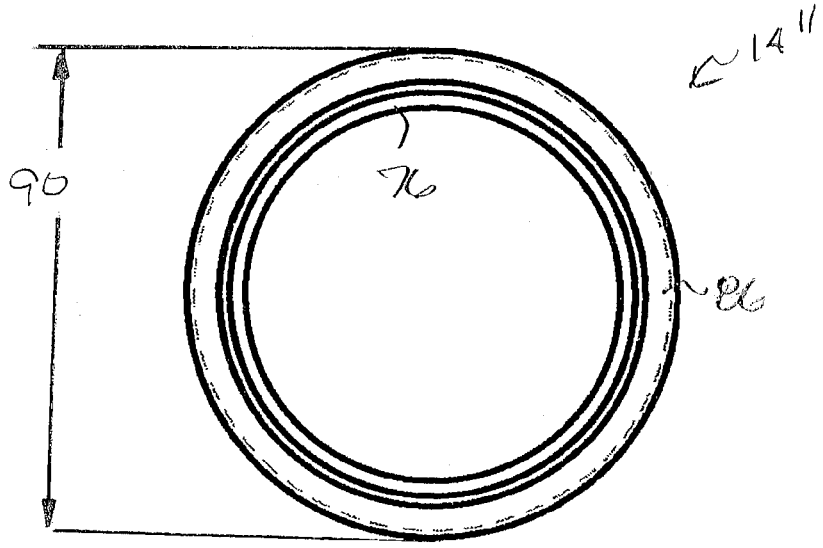
FIG. 14 is a top view of the ferrule of FIG. 13.
Figure 15:
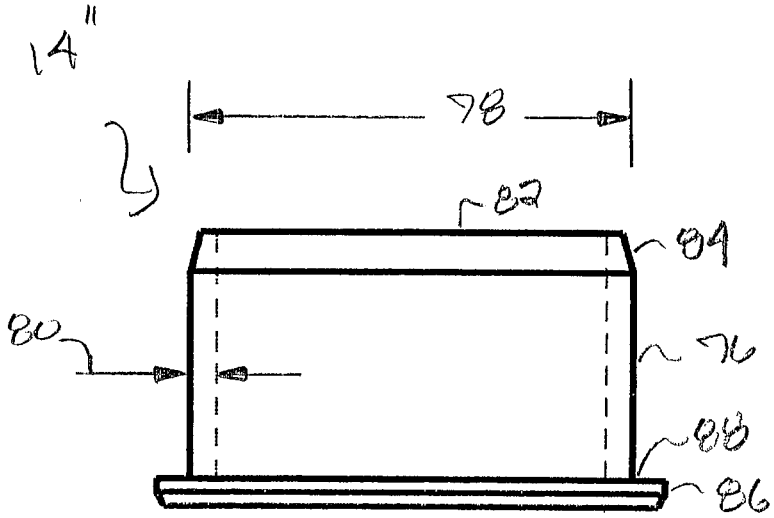
FIG. 15 is a side view of the ferrule of FIG. 13.

With reference to FIGS. 13-15, a third embodiment of the ferrule 14" has a tubular leg engagement section 76 having an outside diameter 78 that is slightly greater than the inside diameter 46 of the furniture leg 18. The resilience and the wall thickness 80 of the leg engagement section 76 are selected to facilitate compression of the leg engagement section 76 during installation of the ferrule 14". For example, the leg engagement section 76 may be composed of a polymeric material such as nylon and have a wall thickness 80 of 0.050 inches. The upper end 82 of the leg engagement section 76 has a tapered outer surface 84 to facilitate insertion of the leg engagement section 76. The foot engagement section 86 is a rim that extends radially outward from the bottom end 88 of the leg engagement section 76. The foot engagement section 86 has an outside diameter 90 that is greater than the outside diameter 26 of the tubular furniture leg 18 and the inside diameter 24 of the foot sleeve portion 22. The ferrule 14" may be a unitary component.

Figure 16:
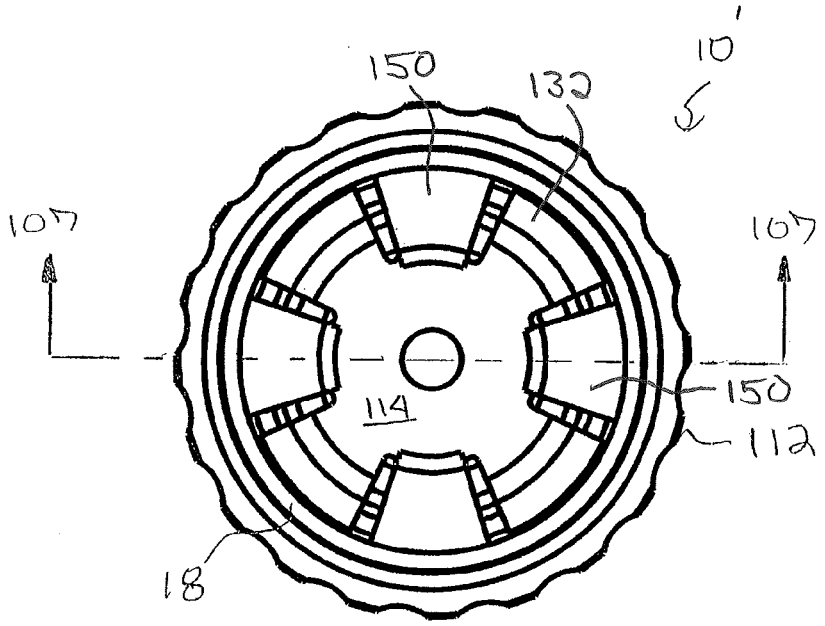
FIG. 16 is a top view of a second embodiment of the furniture glide.

In a second embodiment of a renewable furniture glide 10' in accordance with the disclosure, FIGS. 16, 17 and 18, the foot 112 comprises a shell having a base portion 120 for engaging a floor surface and a sleeve portion 122 for receiving the lower end 16 of the furniture leg 18. The foot 112 may be a unitary or singular component molded from of a resilient material, such as a polymer material. The inside diameter 124 of the sleeve portion 122 may be slightly greater than, equal to, or slightly less than the outside diameter 26 of the leg 18, so long as inside diameter 124 is less than the outside diameter of the foot engagement section 128 as explained in greater detail below. The bottom surface 130 of the base portion 120 may have an arcuate-shape, as shown in FIG. 17, a plow base configuration, or any other shape appropriate for the furniture on which the furniture glide 10' may be used. The base portion 120 may include an annular ring 160 extending axially upward from the upper surface 162, the ring 160 and the inner surface 164 of the sleeve portion 122 defining an annular trough 166. The base portion 120 may also include a cavity 168 extending axially downward from the upper surface 170 of the ring 160.

The ferrule 114 includes an upper, leg engagement section 132 that frictionally engages the inner surface 34 of the leg 18 to fixedly mount the ferrule 114 to the leg 18. A lower, foot engagement section 128 has an outside diameter 136 that is greater than both the outside diameter 26 the furniture leg 18 and the inside diameter 124 of the foot sleeve portion 122. When the ferrule leg engagement section 132 is mounted within the furniture leg 18, a portion 138 of the foot engagement section 128 extends radially outward beyond the outer surface 40 of the leg 18 to frictionally engage the inner surface 142 of the sleeve portion 122 of the foot 112.

Figure 20:
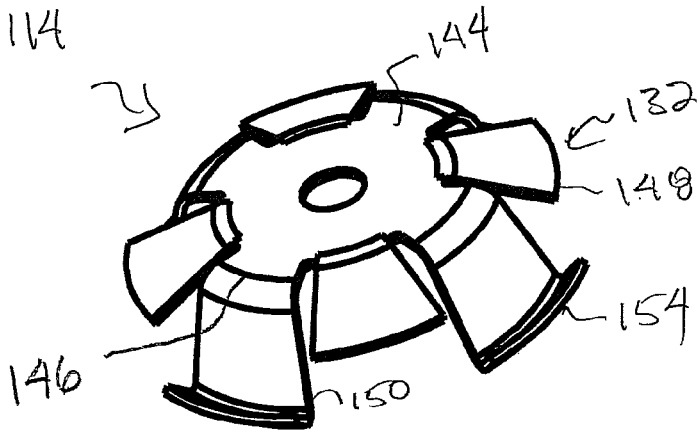
FIG. 20 is a perspective view of the ferrule of FIG. 16.
Figure 21:
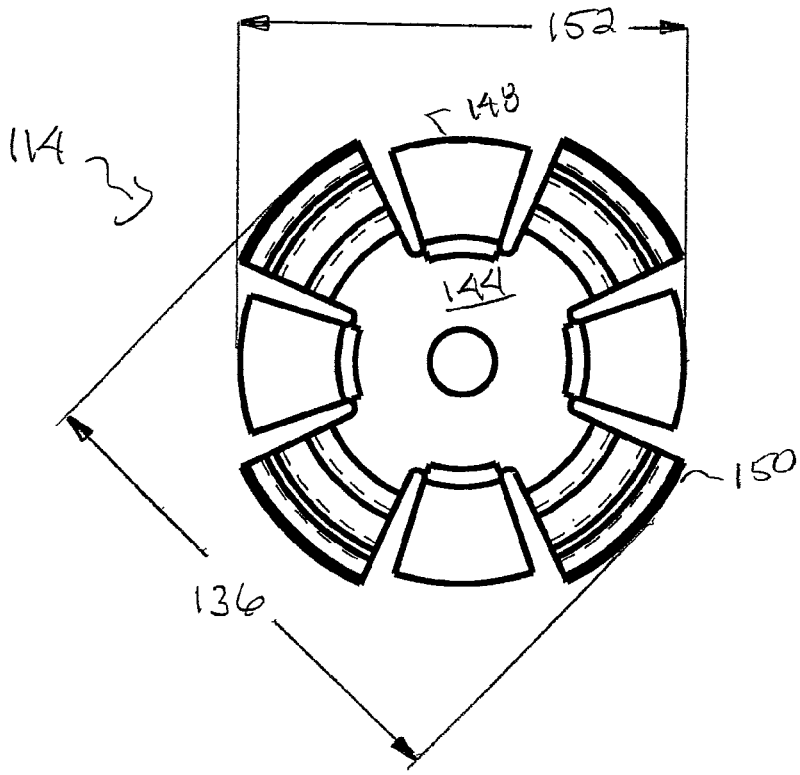
FIG. 21 is a top view of the ferrule of FIG. 17.
Figure 22:
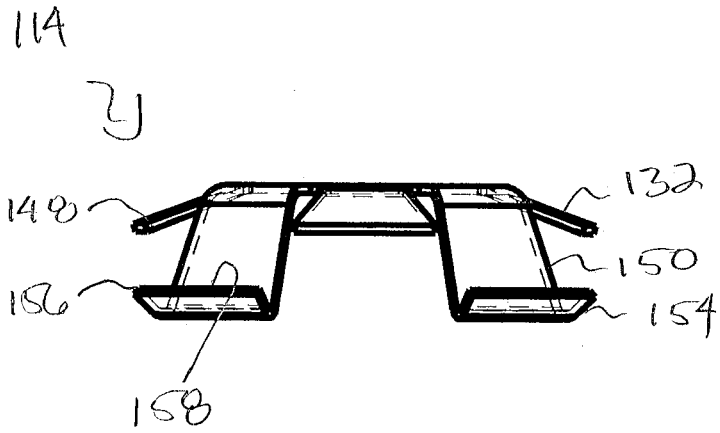
FIG. 22 is a side view of the ferrule of FIG. 17.

With reference to FIGS. 20-22, the ferrule 114 is a unitary component having a central web 144 which has a footprint smaller than the inside diameter 46 of the furniture leg 18. A set of arm segments 148 and a set of leg segments 150 extending radially outward from the perimeter 146 of the web 144, with the arm segments 148 defining the leg engagement section 132 and the leg segment 150 defining the foot engagement section 128. Generally, the arm segments 148 are disposed intermediate the leg segments 150. The unstressed arm segments 148 extend axially downward to define a diameter 152 greater than the inside diameter 46 of the tubular furniture leg 18. The arm segments 148 are resiliently deformable whereby as the leg engagement section 132 is inserted web first into the furniture leg 18, the arm segments 148 deform inwardly to the smaller inside diameter 46 of the furniture leg 18. The arm segments 148 remain resiliently deformed within the furniture leg 18, exerting a clamping force on the furniture leg 18.

Each leg segment 150 extends axially downward from the web 144 to a foot segment 154 that extends radially outward and axially upward to an outer edge 156. The outer edges 156 of the foot segments 154 define an outside diameter 136 that is greater than the outside diameter 26 of the tubular furniture leg and the inside diameter 124 of the foot sleeve portion 122, whereby the outer edges 156 engage the inner surface 142 of the sleeve portion 122 of the foot 112 when the furniture glide is installed. Further, the lower end 16 of the leg 18 engages the upper surface 158 of the foot segment 154 and the weight of the furniture biases the outer edges 156 against the inner surface 142 of sleeve portion 122, thereby exerting a clamping force on sleeve portion 122. The outer surface 172 of the annular ring 160 engages the inner surface 174 of the leg segment 150 to limit movement of the leg segment 150 when the lower end 16 of the leg 18 engages the foot segment 154 ensuring that the outer edges 156 are biased into engagement with the inner surface 142 of the sleeve portion 122 of the foot 112 when the furniture glide is installed. In some examples, outer edges 156 may penetrate or elastically deform inner surface 142. The leg segments 150 are received within the foot trough 166, if one is present.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A furniture glide for use with a tubular furniture leg having inner and outer surfaces defining inside and outside diameters, respectively, the glide comprising:

a foot including a base portion having a bottom surface adapted for contacting a floor, and a sleeve portion adapted to receive a lower end of the furniture leg, the sleeve portion having an inner surface defining an inside diameter; and a ferrule including a single planar central web having a perimeter, a set of arm segments extending radially outward from the web perimeter, the arm segments being adapted to engage the inner surface of the furniture leg, and a set of leg segments, each leg segment extending radially outward and axially downward from the web perimeter to a foot portion that extends radially outward axially upward to an outer edge, the outer edges of the ferrule foot segments penetrating or elastically deforming the inner surface of the foot sleeve portion.

2. The furniture glide of claim 1 wherein the ferrule leg segments have an outside diameter that is greater than the inside diameter of the furniture leg.

3. The furniture glide of claim 2 wherein the ferrule arm segments have an outside diameter that is greater than the inside diameter of the furniture leg.

4. The furniture glide of claim 1 wherein the ferrule is a unitary, monolithic component.

5. The furniture glide of claim 4 wherein each of the arm segments is disposed intermediate a pair of the leg segments.

6. The furniture glide of claim 4 wherein the arm segments are resiliently deformable and extend axially downward.

7. The furniture glide of claim 1 wherein the base portion also has an upper surface and an annular ring extending axially upward from the base upper surface, the ring and the inner surface of the sleeve portion defining an annular trough.

8. The furniture glide of claim 7 wherein the foot portions of the leg segments are disposed in the annular trough of the foot.

9. The furniture glide of claim 7 wherein the ring has an upper surface and the base portion defines an axial cavity extending axially downward from the ring upper surface.

10. The furniture glide of claim 1 wherein the foot portion of each of the leg segments has an upper surface adapted to contact a lower end of the furniture leg, whereby the furniture leg biases the outer edge of the foot portion against the inner surface of sleeve portion.

11. A furniture glide for use with a tubular furniture leg having inner and outer surfaces defining inside and outside diameters, respectively, the glide comprising:

a foot including a base portion having a bottom surface adapted for contacting a floor, and a sleeve portion adapted to receive a lower end of the furniture leg, the sleeve portion having an inner surface defining an inside diameter; and a unitary, monolithic ferrule, the ferrule including a single planar central web having a perimeter, a set of arm segments extending radially outward and axially downward from the web perimeter, the arm segments being adapted to engage the inner surface of the furniture leg, and a set of leg segments, each leg segment extending radially outward and axially downward from the web perimeter to a foot portion that extends radially outward axially upward to an outer edge, the outer edge penetrating or elastically deforming the inner surface of the foot sleeve portion, the leg segments being disposed intermediate the arm segments.

12. The furniture glide of claim 11 wherein the ferrule leg segments have an outside diameter that is greater than the inside diameter of the furniture leg and the ferrule arm segments have an outside diameter that is greater than the inside diameter of the furniture leg.

13. The furniture glide of claim 11 wherein the arm segments and leg segments are resiliently deformable.

14. The furniture glide of claim 11 wherein the base portion also has an upper surface and an annular ring extending axially upward from the upper surface, the ring and the inner surface of the sleeve portion defining an annular trough.

15. The furniture glide of claim 14 wherein the foot portions of the leg segments are disposed in the annular trough of the foot.

16. The furniture glide of claim 14 wherein the base portion defines an axial cavity extending axially downward from an upper surface of the ring.

17. A furniture glide for use with a tubular furniture leg having inner and outer surfaces defining inside and outside diameters, respectively, the glide comprising:

a foot including a base portion having a bottom surface adapted for contacting a floor, an upper surface, and an annular ring extending axially upward from the upper surface, the base portion defining an axial cavity extending axially downward from an upper surface of the ring, and a sleeve portion adapted to receive a lower end of the furniture leg, the sleeve portion having an inner surface defining an inside diameter, the ring of the base portion and the inner surface of the sleeve portion defining an annular trough; and a unitary, monolithic ferrule, the ferrule including a single planar central web having a perimeter, a set of arm segments extending radially outward and axially downward from the web perimeter, the arm segments being adapted to engage the inner surface of the furniture leg, and a set of leg segments, each leg segment extending radially outward and axially downward from the web perimeter to a foot portion that extends radially outward axially upward to an outer edge, the foot portions of the leg segments being disposed in the annular trough of the foot and the outer edges of the leg segments penetrating or elastically deforming the inner surface of the foot sleeve portion.

* * * * *